United States Patent [19]

Lindenmeyer

[11] 4,269,366

[45] May 26, 1981

[54] SHUTTLELESS TOROID WINDER

[75] Inventor: Carl W. Lindenmeyer, Aurora, Ill.

[73] Assignee: The United States of America as represented by the United States Department of Energy, Washington, D.C.

[21] Appl. No.: 28,742

[22] Filed: Apr. 10, 1979

[51] Int. Cl.[3] ..... H01F 41/08

[52] U.S. Cl. ..... 242/4 R

[58] Field of Search ..... 242/4 R, 4 A; 156/185, 156/443

[56] References Cited

U.S. PATENT DOCUMENTS

| | | | |
|---|---|---|---|
| 3,030,038 | 4/1962 | Baker et al. | 242/4 A |
| 3,128,955 | 4/1964 | Stutz | 242/4 R |
| 3,451,632 | 6/1969 | Jagos | 242/4 R |

FOREIGN PATENT DOCUMENTS

| | | | |
|---|---|---|---|
| 45-2501 | 1/1970 | Japan | 242/4 R |

*Primary Examiner*—Billy S. Taylor

*Attorney, Agent, or Firm*—Paul A. Gottlieb; Frank H. Jackson; James E. Denny

[57] ABSTRACT

A lower support receives a toroid at a winding station with the axis of the toroid aligned with a slot in the support. An upper guide member applies an axial force to hold the toroid against the lower support. A pair of movable jaws carried by an indexing mechanism engage the outer surface of the toroid to apply a radial holding force. While the toroid is thus held, a wire is placed axially through the toroid, assisted by a funnel-shaped surface in the upper guide member, and is drawn tight about the toroid by a pair of cooperating draw rollers. When operated in the "full cycle" mode, the operator then actuates a switch which energizes a power drive to release the axial clamp and to drive the indexing mechanism and the jaws to rotate the toroid about its axis. At the same time, the wire is ejected from the draw rollers beneath the toroid so that the operator may grasp it to form another loop. When the toroid is fully indexed, the jaws release it, and the upper guide member is returned to clamp the toroid axially while the indexing mechanism is returned to its starting position. The apparatus may also be operated in a "momentary contact" mode in which the mechanism is driven only for the time a switch is actuated.

17 Claims, 17 Drawing Figures

FIG 10B
FIG 10A
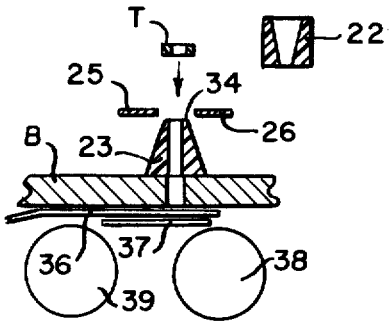
LOAD
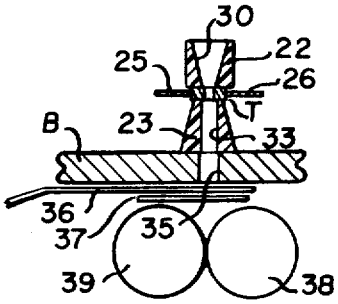
CLAMPED
FIG 10C
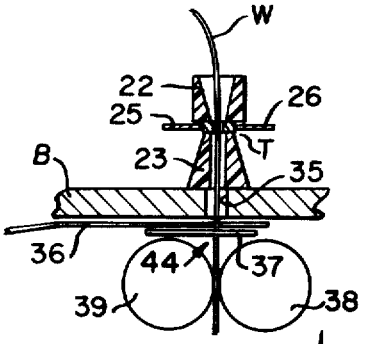
WIRE FED THRU
PRESS FOOT PEDAL
FIG 10D
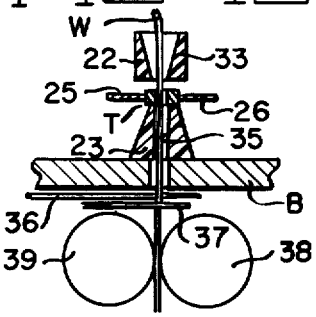
AXIAL CLAMP RELEASED
FIG 10E
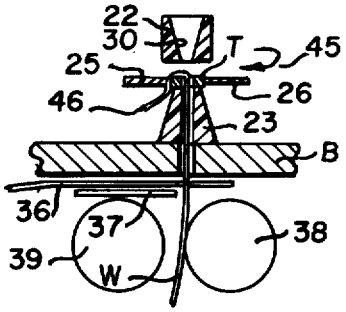
CORE INDEXED; WIRE EJECTED FROM DRAW ROLLERS.
FIG 10F
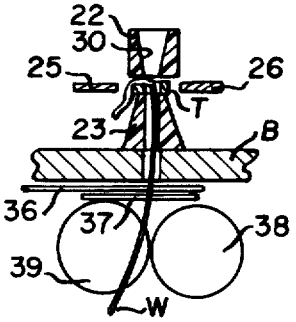
AXIAL CLAMP APPLIED, JAWS RELEASED AND RETURNED.
FIG 10G
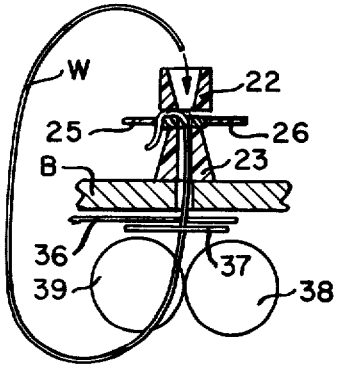
CORE CLAMPED. READY FOR NEXT TURN.
FIG 11
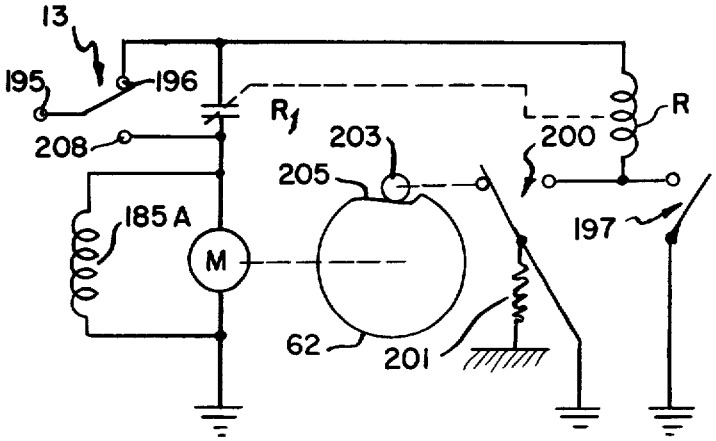

SHUTTLELESS TOROID WINDER

CONTRACTUAL ORIGIN OF THE INVENTION

The invention described herein was made in the course of, or under, a contract with the UNITED STATES DEPARTMENT OF ENERGY.

BACKGROUND AND SUMMARY

The present invention relates to apparatus for winding wire about a core of toroidal shape and made from magnetizable material. The wound core may be an inductor in an electronic circuit, if only one wire is wound around it, or, in the case of two separate wires wound around it, it may be a transformer.

In the past, some machines have used a shuttle in the form of a thin needle for guiding and moving the wire along the axis of the toroid to "loop" the wire about the toroid.

In machines of this type, the size of the toroid is limited by the size of the shuttle since it must be allowed to pass through the center opening of the toroid in forming a loop.

With the current trend toward miniaturization and microminiaturization of electronic circuitry, this has been found to be a limitation. Thus, in particular, the present invention relates to apparatus and method for winding wire about a toroidal core without the need of a shuttle to carry the wire axially through the center opening in the toroid.

Briefly, the apparatus of the invention includes a lower support which may have a vertical slot and which is secured to a base or frame. The upper surface of the lower support is flat for receiving the toroid at a winding station such that the axis of the toroid is aligned with the vertical slot in the lower support.

The toroid is held against the lower support by an upper guide member which applies an axial force against the upper surface of the toroid. The toroid is further held at the winding station by a pair of movable jaws carried by an indexing mechanism which engage the outer surface of the toroid to apply a radial holding force.

To insert a toroid into the winding station, the upper support is raised manually and moved aside. Further, a push actuator releases the jaws to facilitate insertion of the toroid onto the upper surface of the lower support. When the toroid is inserted, the push actuator is released so that the jaws exert the radial holding force on the toroid, and the upper guide member is also returned to its operating position to clamp the toroid against the lower support. Preferably, the jaws are mounted to arms of leaf spring material so as to permit the jaws to accommodate themselves to the axially clamping motion of the upper guide member while maintaining their radial holding force on the toroid.

With the toroid thus held both radially and axially at the winding station, an operator places a wire axially through the center of the toroid. Beneath the toroid are a pair of draw rollers, one of which is continuously driven. While inserting the wire, it is guided toward the center opening of the toroid by a funnel-shaped guide surface in the upper guide member, and it is guided toward the draw rollers by the slot in the lower support. In the operating position, the draw rollers engage each other so that when the wire enters the nip between the draw rollers, it is pulled through the center of the toroid and drawn tight.

The machine is capable of being operated in either a "full cycle" mode, in which the operator may use a foot pedal or other switch for each complete loop that is formed about the toroid by the wire, or a "momentary contact" mode in which the operator uses a separate switch to actuate the mechanism for only that portion of a cycle during which the momentary contact switch is actuated.

Assuming that the machine is being operated in the full cycle mode, the operator then actuates the foot pedal switch, and a power source is engaged to release the axial clamp of the guide member on the toroid so that it is held only by the jaws.

The power source then drives the indexing mechanism and the jaws to rotate the toroid about its axis, while maintaining the toroid at the winding station. At this time, the wire is ejected from the draw rollers beneath the toroid so that the operator may easily grasp the free end of the wire and return it upwardly to the top of the guide member.

When the toroid is fully indexed, the power drive causes the jaws to release the toroid, and it also returns the upper guide to clamp the toroid axially. While the toroid is thus clamped at the winding station, the power drive returns the indexing mechanism to its starting position. When the indexing mechanism is returned to the starting position, the power drive mechanism again causes the jaws to clamp the toroid radially, and the mechanism is prepared for a new cycle. By operating the apparatus in the momentary contact mode, it is possible to cause the mechanism to go through any portion of a cycle that is desired, or to operate continuously, as long as the momentary contact mode switch is actuated.

With the present invention, an operator is able to form a complete loop of wire about a very small toroid in about a second, and the only limitation on the size of the toroid is the diameter of the wire being used. Since the core is indexed after each loop is formed, the wire is laid side-by-side about the toroid, which provides a more efficient packing of the wire in the center of the toroid and more uniform electrical characteristics of the core.

Other features and advantages of the present invention will be apparent to persons skilled in the art from the following detailed description of a preferred embodiment accompanied by the attached drawing wherein identical reference numerals will refer to like parts in the various views.

DESCRIPTION OF THE FIGURES

FIGS. 10A-10G are diagrammatic illustrations of some of the steps of the method invention; and FIG. 11 is a schematic drawing of the control circuitry for the apparatus of FIGS. 1-9.

DETAILED DESCRIPTION OF THE INVENTION

Figure 1:
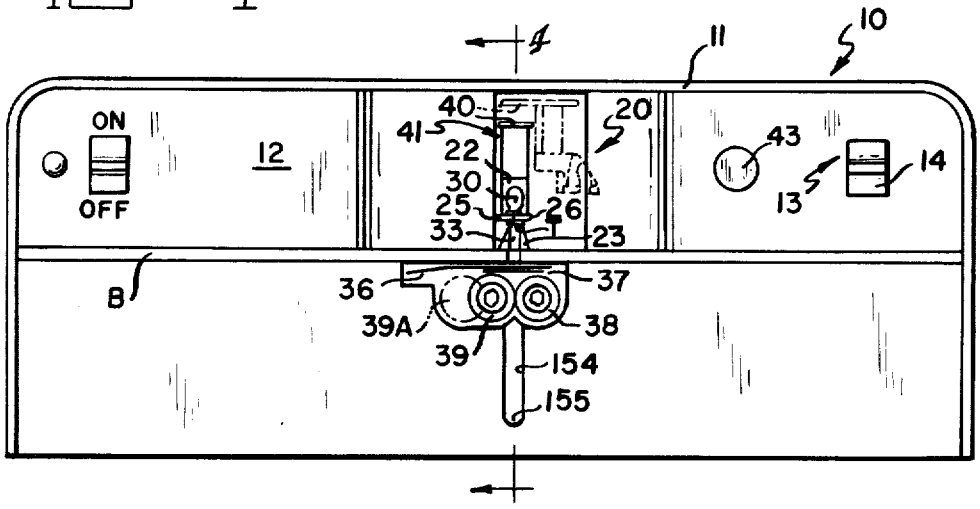
FIG. 1 is a front view of a machine incorporating the apparatus of the present invention.

Before discussing the apparatus in its structual detail, it will be helpful if the broader functional elements and operation of the invention were understood. Referring then to FIG. 1, the apparatus is housed within a casing generally designated 10 and including a cover 11 and a front or control panel 12. A function select switch 13 has three positions. In the center position shown, the mechanism does not run. If the actuating lever 14 is raised, the switch includes an internal spring bias which tends to return it to the off position, but as long as the switch is in the raised position, the apparatus operates in a momentary contact mode—that is, the machine will continue to run or cycle as long as the switch actuator is held in the momentary contact position. If the switch actuator 14 is moved downwardly, the apparatus operates in a full cycle mode under control of the operator, preferably by means of a foot pedal or the like. In this mode, the apparatus will assist the operator to wind the wire one complete turn around the toroid and then come to a stop, waiting for the operator to rethread the wire and again actuate the foot pedal, as will be described in more detail below.

The toroid, designated T in FIG. 1, is located at a winding station generally designated 20, and positioned such that its axis extends vertically.

The toroid is retained and held against vertical movement by an upper guide member 22 which presses the toroid against a fixed lower support 23. Together, these elements and the mechanism which actuates the upper guide member form an axial clamp and inlet wire guide for the toroid.

The toroid is held against lateral displacement and rotation by a pair of jaws 25, 26. The jaws are provided with opposing curved surfaces 27, 28 respectively (see FIG. 5) for engaging the outer cylindrical surface of the toroid to thereby provide a radial gripping force.

Figure 2:
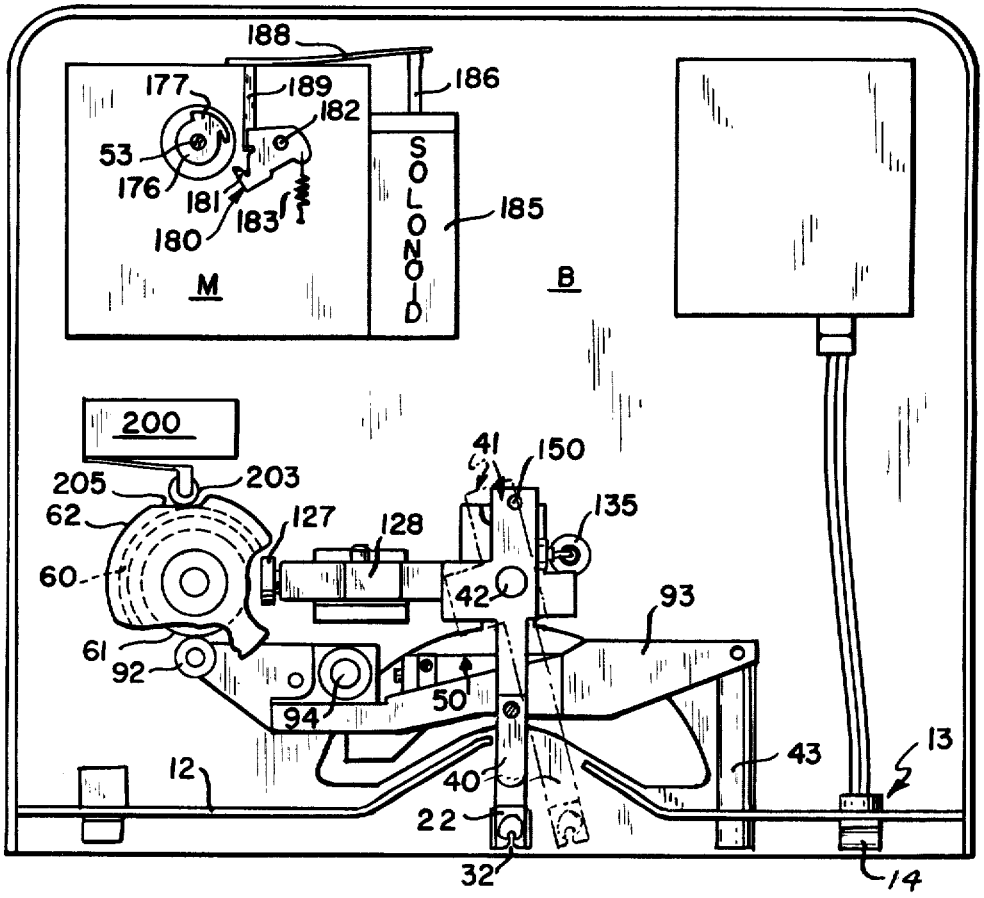
FIG. 2 is a plan view of the machine of FIG. 1 with the cover removed, with portions of the main drive cam broken away, and with the upper guide member shown in its two lateral positions.

Referring for a moment to FIG. 10B, the upper guide member 22 has a funnel-shaped guide surface 30, the axis of which is aligned with the axis of the toroid T. Further, as illustrated in FIG. 2, the upper guide member 22 includes a vertically extending slot 32 which communicates the axis of the toroid with the front of the apparatus.

Returning then to FIG. 10B, the lower support 23 also contains a slot 33 which extends beneath the central aperture of the toroid T and is aligned with slot 32 in a radial plane of the toroid. These slots cooperate to guide the wire about the toroid in the formation of a loop. The lower support member 23 preferably has a flat, horizontal upper surface designated 34 in FIG. 10A which is adapted to hold a toroid when it is initially placed at the winding station 20, and the upper guide member 22 is moved to one side, and the jaws 25, 26 are separated, as will be described in further detail below.

Still referring to FIGS. 1 and 10B, the lower support member 23 is mounted to a horizontal mounting or base plate B which serves as a frame for most of the apparatus and mechanism to be described. The base plate B also is apertured at 35 in alignment with the axis of the toroid T as it is held at the winding station 20.

Beneath the base plate, there are a pair of cooperating actuators or fingers designated 36 and 37 respectively; and beneath these fingers are a pair of draw rollers 38, 39.

Figure 7:
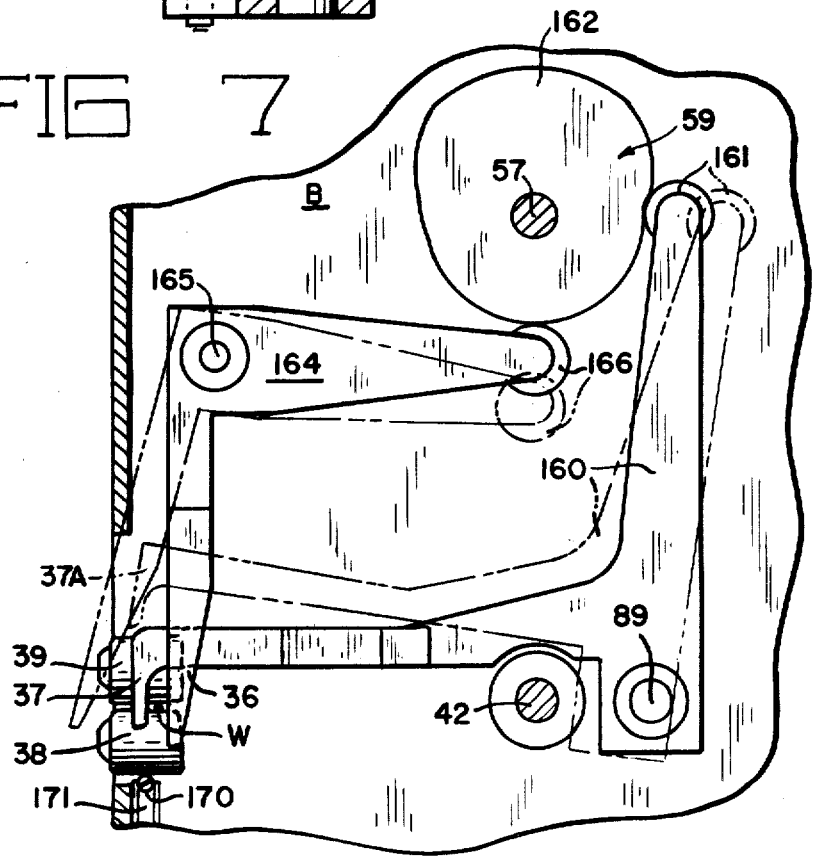
FIG. 7 is a fragmentary close-up top view of the mechanism which actuates the fingers for retaining and ejecting the wire beneath the draw rollers.

The finger 36 is sometimes referred to as the ejector finger because it is reciprocated in and out of the plane of the page of FIG. 10B to eject the wire W after it is drawn tight by the rollers 38, 39, at the proper time of the operating cycle. The finger 37 is reciprocated in a horizontal plane to the left of the position shown in FIG. 10B (see FIG. 10E) when the wire is ejected. In the position shown in FIG. 10B, the finger 37 retains the wire W in a general axial position so that it continues to be engaged by the draw rollers 38, 39 (FIG. 7).

The roller 38 is mounted for pivotal motion about a fixed position, and it is surface-driven, as will be described. The roller 39 is an idler roller, and it is rotatably mounted in such a manner that it can be moved to the left, out of driving engagement with the wire W, as seen in FIGS. 10D and 10E.

Operation

Figure 4:
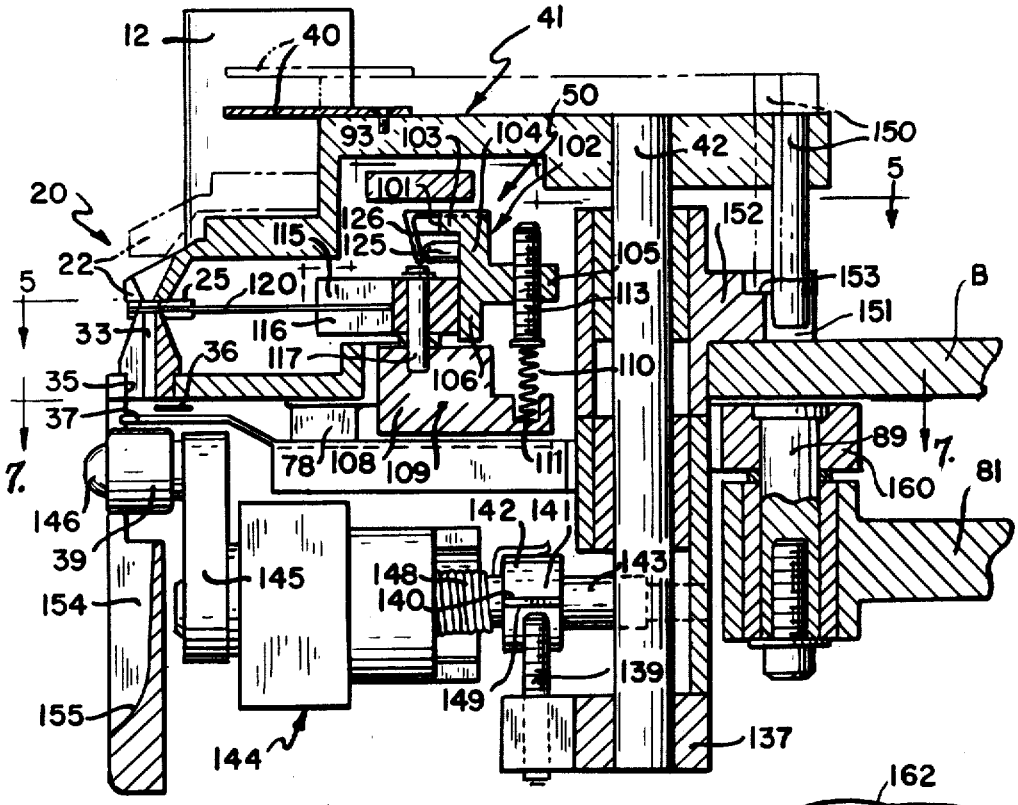
FIG. 4 is a framentary vertical cross sectional view taken from the left as seen through the sight lines 4—4 of FIG. 1.

In operation, then, a toroid T is placed on the support surface 34 of the lower support 23 at the winding station 20, after the upper guide member 22 is manually moved to the side by grasping the handle designated 40 in FIG. 4, raising the upper guide assembly generally designated 41, and rotating it about a shaft 42.

At the same time, the jaws 25, 26 are manually separated, as illustrated in FIG. 10A, by depressing the push actuator 43 as seen in FIGS. 1 and 2.

After the toroid is properly located, the push actuator 43 is released, thereby causing the jaws 25, 26 to grip the toroid, and the upper guide member 22 is returned to its operative position, and forced downwardly under spring pressure to exert an axial retaining force on the toroid. The operator then guides the free end of the wire W into the funnel-shaped guide surface 30 of the guide member 22. The wire will extend through the slot 33 in the lower guide member and to the aperture 35 in the base B, as seen in FIG. 10C.

The operator continues to move the wire downwardly in front of the ejector finger 36 and behind the retainer finger 37, and into the nip 44 of the draw rollers, 38, 39 (see FIG. 10C) which will immediately engage the wire and draw it tightly through the core aperture. If it is the first time that the wire is threaded through the toroid, the trailing end of the wire is anchored or held in some manner. If a previous loop had been formed, the draw rollers, in drawing the wire tightly, will form a complete loop of the wire about the toroid, and that loop will lie generally in a plane perpendicular to the plane of the page of FIG. 10C, and extending through the axis of the toroid.

After the wire is drawn tightly by the draw rollers, assuming that the function switch is in the "complete cycle" mode, the operator then actuates the cycle switch, which may be in the form of a foot pedal switch. This causes the drive mechanism to go through a complete cycle. The drive mechanism, also to be described in further detail below, includes a first cam actuator which raises the upper guide member 22 slightly, as seen in FIG. 10D. This causes the leaf spring arms on which the jaws 25, 26 are mounted to lift them slightly, thereby suspending the toroid T a slight distance above the lower support 23, at least for the formation of the first loop (that is, provided it is not being held down by tension on the wire in the draw rollers). Next, an indexing drive mechanism rotates the jaws 25, 26 clockwise (when viewed from the top) in the direction of the arrow 45 in FIG. 10E, thereby indexing the toroid T (as well as any previously-formed loop of wire on the toroid). At this time, the operator will have taken the trailing end 46 of the wire and removed it from the upper guide member 22 through the forward slot and bent it over as seen in FIG. 10E to permit it to ride beneath the upper guide member.

While the jaws are being indexed, the cam actuator for the upper guide member 23 continues to raise it slightly, and this further cam action moves the idler roller 39 to the left to disengage the wire W. While the jaws are being indexed, the retainer finger 37 is rotated out of the way to the left.

When the jaws are in the fully indexed position, as seen in FIG. 10F, four things happen: (1) the upper guide member is lowered to apply an axial retaining force on the toroid; (2) the jaws are opened to release their radial gripping force on the toroid; (3) the ejector finger 36 is moved outwardly to facilitate the grasping of the leading end of the wire W by an operator free of the draw rollers; and (4) the draw rollers are brought back into frictional engagement after the wire is ejected.

The indexing mechanism for the jaws then rotates them back to their original position as seen in FIG. 10G and closes them to engage the toroid and apply the radial gripping force. During this period, the operator takes the leading edge of the wire which had been ejected from beneath the draw rollers, and loops it about as seen in FIG. 10G, again placing the leading edge in the direction of the arrow 47 through the funnel-shaped surface of the upper guide member and forcing it through the toroid, the lower guider member and between the fingers 36, 37, until the draw rollers engage it and draw it tightly about the toroid in the formation of a new loop.

When the operator has formed as many loops as desired, he lifts the upper guide member 22 and rotates it to the side, and releases the jaws by depressing the push actuator described above, thereby returning the apparatus to the condition shown in FIG. 10A, in preparation of the insertion of a new toroid.

Indexing Mechanism For Jaws (Radial Grippers)

Figure 6:
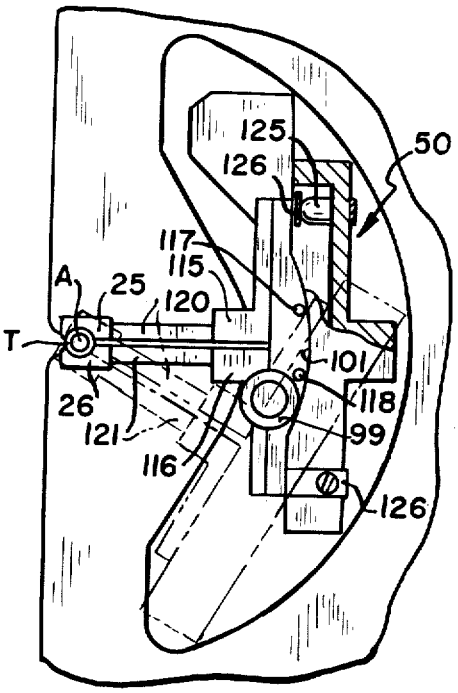
FIG. 6 is a framentary close-up top view of the indexing head, seen in both limit positions.

Referring to FIG. 6, the jaws 25, 26 are carried by an indexing head generally designated by reference numeral 50 which is oscillated between the original or starting position seen in solid line in FIG. 6 and the indexed position seen in chain line in FIG. 6. As will be described below, the indexing head 50 contains structure which normally urges the jaws 25, 26 into radial gripping engagement with the toroid T so that when the head 50 is indexed to the position shown in chain line, it rotates the toroid T about its axis designated A in FIG. 6 approximately thirty degrees clockwise, when viewed from the top. During the indexing motion the jaws grip the toroid, and during the return motion, the jaws disengage the toroid, and the axial clamping force is applied by the upper guide member, as alluded to above and as will be described in more detail below.

Figure 3:
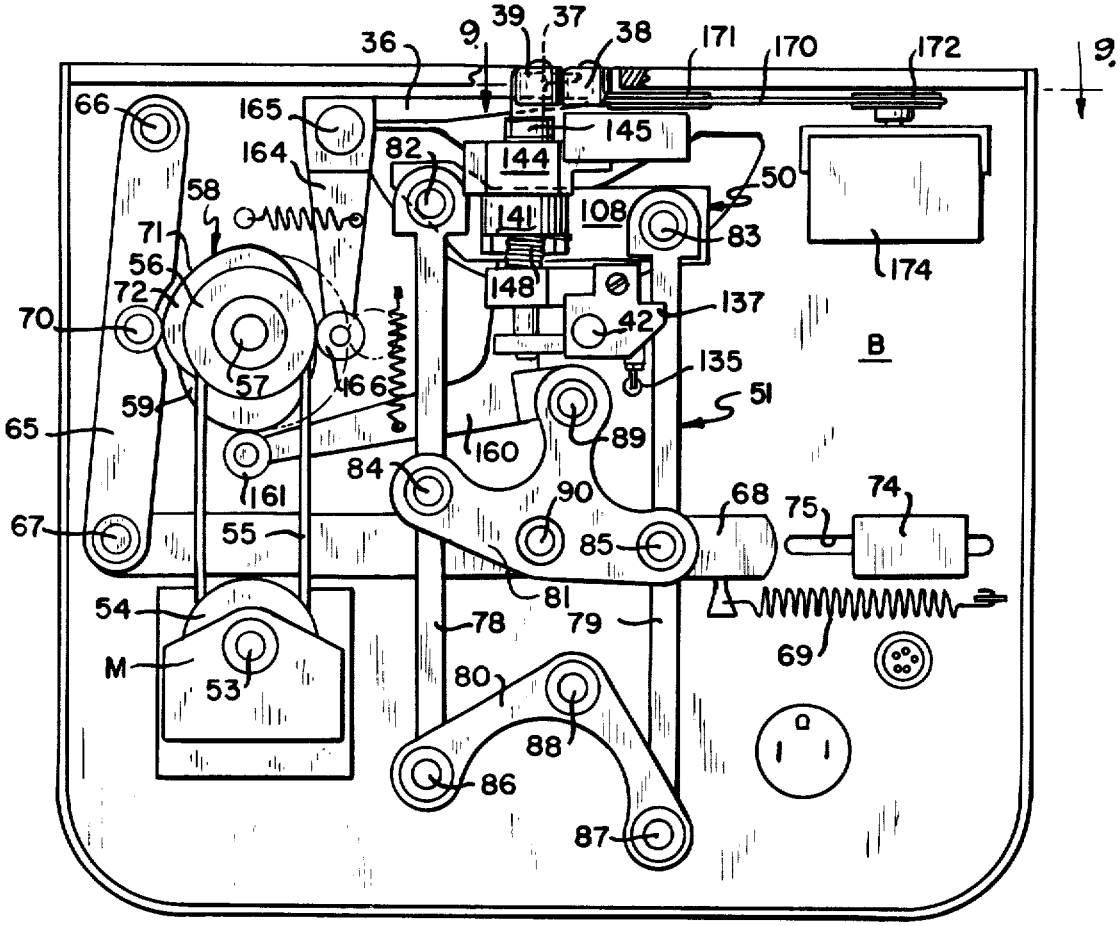
FIG. 3 is a bottom view of the apparatus of FIG. 1 showing the power drive for indexing the toroid and ejecting the wire.

The indexing head 50 is seen in vertical cross section in FIG. 4, and it is seen from the bottom in FIG. 3 where the indexing mechanism generally designated 51 can also be seen.

Power for the indexing mechanism is derived from a motor M in FIG. 2 which is mounted to the base B and includes a vertically oriented shaft 53.

Referring back to FIG. 3 (where the front of the machine faces the top of the page), the shaft 53 of the motor M extends downwardly, and a pulley 54 is connected to it. A cogged belt 55 is trained about the pulley 54 and a second pulley 56 mounted on a vertically oriented shaft 57. The shaft 57 has five actuating cams secured to it. Two of them are mounted beneath the base B and designated 58 and 59 respectively. These cams operate the indexing drive mechanism and the retainer/ejector finger mechanism respectively. The other three cams are mounted to the shaft 57 above the base B, as seen best in FIG. 8. These include a vertical displacement cam surface 60 for reciprocating the upper guide member vertically as well as for partially opening the draw rollers to release the wire after a loop has been formed. A cam surface 61 opens the gripping jaws during their return to the starting position. A final cam surface 62 defines a complete cycle of operation for the mechanism in the "full cycle" mode of operation.

Returning now to the indexing drive mechanism 51, it includes a link 65 which is pivotally mounted at 66 to the bottom of the base B. The other end of the link 65 is pivotally mounted at 67 to a link 68 which is biased toward the right in FIG. 3 by means of a spring 69. A cam follower 70 is mounted at an intermediate position on the link 65 for engaging the cam surface 71 of the indexing drive cam 58. The spring 69, connected between the link 68 in the base B urges the cam follower 70 against the cam surface 71. It will be observed that the cam 58 has a major lobe 72 which rotates the link 65 about the pivot 66, thereby reciprocating the link 68 as the indexing drive cam 58 is rotated. The right end of the link 68 engages a stop member 74 which is adjustably secured in a slot 75 in the base B.

The indexing drive mechanism 51 also includes a pair of longitudinal "push-pull" links 78, 79, a V-shaped link 80, and a T-shaped link 81.

The links 78, 79 are connected to the indexing head 50 by pivotal connections 82, 83. Further, these links are pivotally connected to the crossbar of the T-link 81 at 84, 85 respectively, passing between the T-link 81 and the cross link 68. Similarly, the lower ends of the links 78, 79 are pivotally connected to the outboard ends of the V-link 80 at 86, 87 respectively. The point of the V-link 80 is pivotally mounted at 88 to the base B. The base of the T-link 81 is pivotally mounted at 89 to the base B, and it is pivotally mounted at 90 to the cross link 68.

As the cross link 68 moves to the right in FIG. 3, T-link 81 and V-link 80 pivot counterclockwise about their respective pivotal mounting 89, 88. This causes longitudinal link 79 to be both translated to the right and moved upwardly such that the axis of the pivotal connection 83 (which is connected to the indexing head 50) transcribes an arc centered about the axis of the toroid. Similarly, the link 78 is translated towards the right, but moved downwardly so that the axis of the pivotal connection 82 transcribes a similar arc. In this manner, the indexing head 50 is oscillated between its indexed and starting positions while rotating the indexing head about the axis of the toroid to rotate the toroid, without moving its axis.

Mechanism For Actuating Jaws (Radial Grippers)

Figure 8:
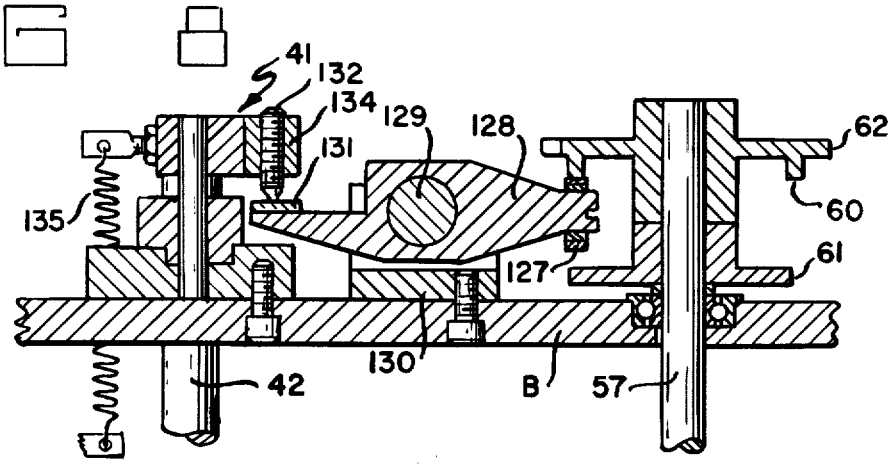
FIG. 8 is a fragmentary vertical cross sectional view as viewed from the rear and taken through the sight line 8—8 of FIG. 5, showing the vertical cam surface for actuating the upper guide member.
Figure 5:
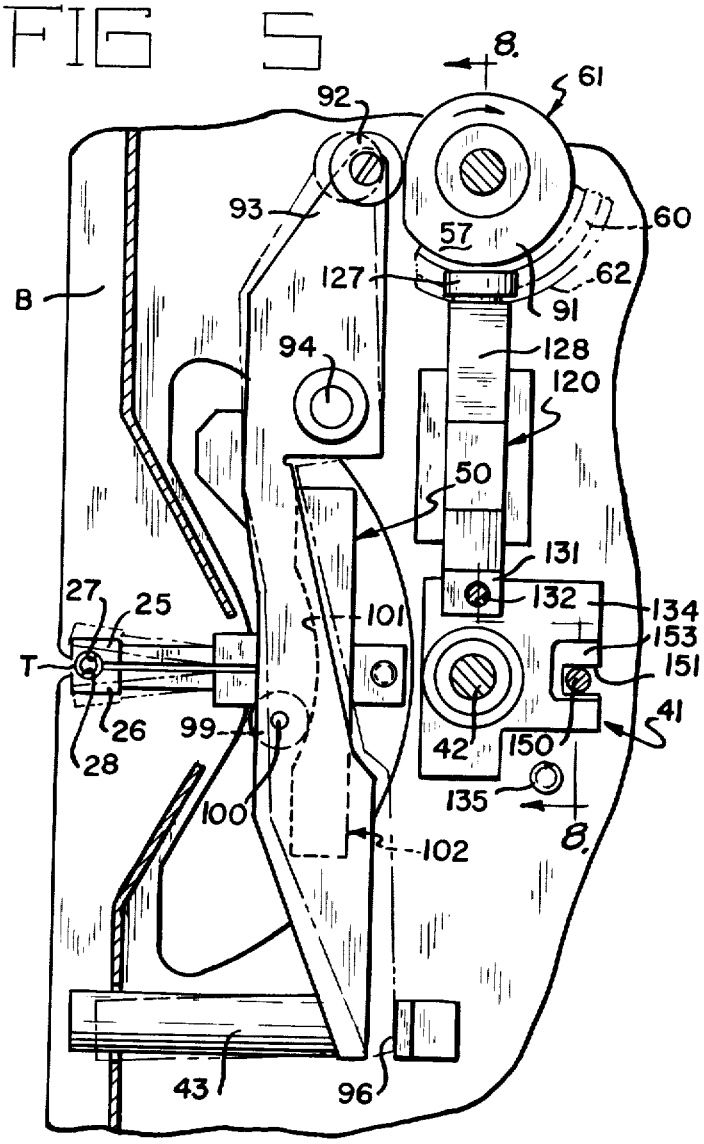
FIG. 5 is a fragmentary vertical cross sectional view taken through the sight lines 5—5 of FIG. 4.

Referring now to FIG. 5, the cam 61, referred to in connection with FIG. 8 above, includes an outwardly projecting lobe 91. A cam follower 92 is mounted on a lever 93 which is pivotally mounted at 94 to the base B. At the far end of the lever (toward the bottom of FIG. 5), the previously described push actuator 43 is secured. Both the lobe 91 and the push actuator 43 cause the link 93 to rotate counterclockwise about its pivotal mounting 94 (as viewed from the top). A stop member 96 is secured to the base B to limit the motion of the lever 93 in opening the jaws 25, 26 (as will be described presently).

A follower member 99 is rotatably mounted at 100 to the lever 93, and the outer surface of the follower member is located beneath the lever 93 for engaging a curved surface 101 on a cradle 102 forming a part of the indexing head 50. The cross sectional shape of the cradle is best seen in FIG. 4 as including a top 103, a back 104 and a centrally located rear tab 105. At each side of the cradle, there is a downwardly extending ear, the left one of which is seen in FIG. 4 and designated 106. These ears support the cradle above a base 108 of the indexing head. The indexing head is supported, as described above, by the pivotal connections 82, 83 to the push-pull links 78, 79 respectively. The cradle, in turn, as just mentioned, is mounted to the base 108 of the indexing head for pivotal motion about a transverse axis designated 109 in FIg. 4. The cradle is held in the position shown by means of a coil spring 110 having one end received in a recess 111 on the base 108, and the other end connected to an adjusting screw 113 threaded into the tab 105 of the cradle 103. The cradle is limited in its forward rotation by engagement of the back 104 against a pair of L-shaped crank members 115, 116 (see FIG. 6) which are mounted to the base 108 of the indexing head for pivotal motion about respective vertical axes 117, 118—again in FIG. 6. Still referring to FIG. 6, the forwardly projecting portions of the L-shaped cranks 115, 116 carry the leaf springs 120, 121 on which the gripper jaws 25, 26 are mounted respectively.

Referring back to FIG. 4, for the L-shaped crank 115, the leaf spring 120 can be seen, as well as its pin connection 117 to the base 108. The outboard end of each of the L-shaped cranks is provided with a curved upwardly projecting nub, one being shown at 125 for the crank 115 which is located within the cradle 102 and engaged by a leaf tab 126 mounted to the top of the cradle and extending downwardly and inwardly thereof. When the cradle is moved rearwardly in FIG. 4, pivoted about the axis 109, and against the bias of spring 110, the leaf tab 126 engages the nub 125 attached to the outboard end of the L-shaped crank 115 to cause the crank to rotate about pin 117 and thereby cause the jaw 25 to move away from the toroid—that is, to open the jaw.

A similar opening structure is provided in connection with the complementary L-shaped crank 116, and this portion of the mechanism is actuated when the follower 99 on the lever 93 engages the curved surface 101 located in the top 103 of the cradle 102 (compare FIGS. 4 and 5) to rotate the cradle rearwardly.

The curvature of the surface 101 preferably is centered on the axis A of the toroid so that the jaw-opening mechanism just described can be actuated during the complete return cycle of the indexing head. That is, referring to FIG. 5, when the head 50 returns from the indexed position to the starting position, the lobe 91 on cam 61 is rotated to shift the follower 92 to the position shown in chain line. This, in turn, rotates the lever 93 counterclockwise about its pivot connection 94, thereby causing the follower 99 to engage the curved surface 101 on the cradle 102, rocking it rearwardly and opening the jaws 25, 26 during the complete return half cycle. The same action just described can be effected manually by the operator by depressing the push-actuator 43 to release the radial clamping force on the toroid, and it will be observed that the manual release can be accomplished irrespective of the position of the indexing head, again due to the cooperation of the follower 99 and the curved surface 101 on the cradle 102. Referring to FIG. 6, it will be observed that irrespective of the position of the indexing head 50, the curved vertical surface 101 transcribes an arc about the axis A of the toroid T, and can be actuated by the roller 99 is either limit position of the indexing head, or in any intermediate position.

Actuating Mechanism For Upper Guide (Axial Clamp)

As indicated above, the upper guide assembly 41, on which the upper guide member 22 is mounted, includes shaft 42 which has its axis vertically oriented and is free to rotate to move the upper guide member between the use position in which the toroid is axially clamped, and the side position (in which the upper guide assembly is placed for removing a wound core or inserting a new toroid).

Referring now to FIGS. 2, 5 and 8, the cam surface which raises and lowers the upper guide member during normal winding operation is designated 60 in FIG. 8, and it is a horizontal surface (i.e. vertical displacement). It is engaged by a follower 127 connected to a lever or rocker arm 128 which is mounted on a shaft 129 for rotation about a horizontal axis. The shaft 129 is carried, in turn, by a bracket 130 attached to the base B.

The other end of the lever 128 includes a pad 131 which is engaged by a vertical adjustment member 132 threadedly received in an offset 134 of the upper guide assembly 41. When the actuation portion of the cam surface 60 displaces the follower 127 (which occurs during a normal operating cycle just before the indexing mechanism begins to rotate the jaws to the indexed position), the lever 128 is rotated clockwise in FIG. 8 to raise the upper guide assembly 41 against the bias of a tensioned coil spring 135.

Referring now to FIG. 4, the lower portion of the vertically reciprocal shaft 42 has a base 137 attached to it; and a screw 139 is threadedly received in the base 137 for vertical adjustment.

The upper end of the screw 139 is adapted to engage a contact pad 140 on the lower surface of a radially projecting tab 141 on a collar 142. The collar 142 is fixed on a horizontal shaft 143 which is received in a bearing block generally designated 144. A crank arm 145 is attached to the forward end of the shaft 143, and the distal end of the crank arm 145 is provided with a pin 146 on which the idler roller 39 is freely rotatably mounted. A coil spring 148 is received on the shaft 143 between the collar 142 and the bearing block 144; and it urges the collar 142 clockwise (when viewed from the front) so as to bring the idler roller 39 into engagement with the driven roller 38. In this position, there is a slight separation as at 149 between the screw 139 and the contact pad 140 on the collar 142. In this manner, the tension of the previously described coil spring 135 (FIG. 8) primarily determines the axial clamping force on the toroid; whereas the force of the spring 148 may be a larger force causing the draw rollers to engage.

When the upper guide assembly 41 is moved upwardly by the cam surface 60, it has a first dwell portion which displaces the shaft 42 vertically by an amount sufficient to release the axial clamping force induced by the upper guide member 22 on the toroid T. This permits the spring action of the leaf springs 120, 121 to raise the gripper jaws 25, 26 slightly, if they are not being held down by the wire. Following this dwell, the cam surface 61 has a portion which displaces the shaft 42 a little more vertically, causing the screw 139 to engage the pad 140 and rotate the collar 142 to crank the idler roller 39 out of engagement with the drive roller 38 (compare FIGS. 10D and 10E) to permit the ejector mechanism to displace the wire outwardly where it can be grasped by the operator. During both of these operations, a pin 150 (see FIG. 4) depending from the rear end of the upper guide assembly 41 is received in a hole 151 in a block 152 to prevent turning of the upper guide assembly 41 about the shaft 42. However, if the operator desires, he may lift the entire upper guide assembly by grasping the handle 40 and displacing the pin 150 above the hole 151. This permits the upper guide assembly to be moved to the side position shown in chain line in FIG. 2, and it is held in the raised position while so rotated as the pin 150 rides on surface 153 adjacent aperture 151, as seen in FIG. 4. In this manner, the idler draw roller 39 can be moved to the far left position shown at 39A in FIG. 1. It will also be observed that the lower portion of the front panel of the housing for the apparatus defines an elongated slot 154 for receiving the leading edge of the wire after it exits the draw rollers 38, 39, and the lower edge of the slot may be curved outwardly as at 155 to force the string outwardly to facilitate grasping by the operator.

Ejector and Retainer Finger Mechanism

Referring now to FIGS. 3 and 7, which show the operation of the ejector finger 36 and retainer finger 37 from the bottom and top respectively, as mentioned above, both fingers are actuated by cam 59 which is mounted to the shaft 57 between the base B and the indexing cam 58.

The retainer finger 37 is mounted to the forward end of a L-shaped crank arm or lever 160. The crank arm 160 is pivotally mounted for rotation about the same axis as the previously described T-link 81. The other end of the crank 160 includes a cam follower 161 which, when actuated by the lobe 162 of the cam 59, rotates the crank 160 clockwise in FIG. 7 (counter-clockwise in FIG. 3) to the position shown in dashed line at 37A so that when the draw rollers are spread apart and the ejector finger 36 is actuated, the wire W is moved outwardly. As viewed in FIG. 7, the cam 59 rotates clockwise so that the retainer finger 37 is moved out of the way before the ejector finger 36 is actuated. In its normal position, however, the retainer finger 37 extends in front of the wire W, and the ejector finger 36 is located behind it, in relation to the nip formed by the draw rollers.

Similarly, the ejector finger 36 is mounted to an L-shaped crank 164 which is pivotally mounted at 165 beneath the base B, and its other end is provided with a follower 166 which, when engaged by the lobe 162 on the cam 159, rotates the crank 164 clockwise so that the ejector finger 36 engages the wire W and displaces it from its normal position. This does not occur until the idler roller 39 is moved out of engagement with the wire.

Figure 9:
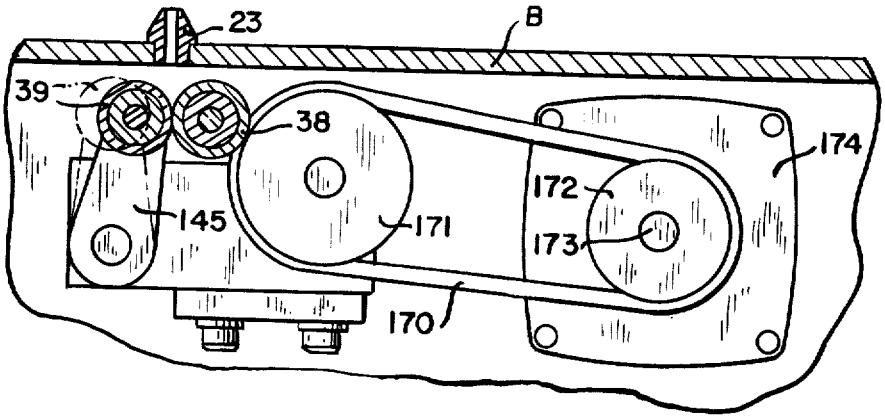
FIG. 9 is a fragmentary vertical cross sectional view, looking from the front and taken through the sight line 9—9 of FIG. 3, illustrating the drive means for the draw rollers.

Referring now to FIG. 9, the driven roller 38 is surface-driven by an O-ring belt 170 entrained around an idler pulley 171 and a driven pulley 172, the latter being connected to a shaft 173 of an electric motor 174. The motor 174 is in continuous operation as long as the machine is turned on. The O-ring belt 170 and the surfaces of the draw roller 38, 39 may be made of an elastomeric material.

Power Drive and Circuit Schematic

Returning to FIG. 2, the upper portion of the shaft 53 of the main drive motor M is provided with a collar 176 which has a radially projecting stop member 177. A brake member 180 includes a hook 181; and it is mounted for rotation on a shaft 182. The brake member 180 is biased by means of a spring 183 clockwise about the shaft 182 so that the hook 181 is in a position to engage the stop member 177. A solenoid 185 has a plunger 186 normally biased outwardly to displace a leaf spring 188 outwardly. A link 189 is connected between the leaf spring 188 and the brake member 180, tending to rotate the brake member counterclockwise to disengage the hook 181.

When the motor M is energized, the coil of solenoid 185 is also energized, thereby retracting the plunger 186 and permitting the leaf spring 188 to displace the link 189 and rotate the brake member counterclockwise about its shaft 182 against the force of spring 183. This permits the shaft 53 of the motor M to rotate freely. When the motor is de-energized, so is the solenoid 185, and the plunger 186 displaces the leaf spring 188 outwardly, thereby permitting the spring 183 to rotate the brake member 180 clockwise to stop and brake the motor.

Referring now to FIG. 11, input electric power may be connected to a terminal 195, which is connected to the movable contact of the mode selection switch generally designated 13. In the "full cycle" or foot pedal mode, the movable contact of the switch 13 engages a terminal 196 which is connected to the coil of a relay R. The other terminal of the coil of relay R is connected to a junction between the normal open terminals of a cam-actuated switch generally designated 200 (see also FIG. 2) and the foot pedal 197. A normally open contact R1 of relay R is connected between the terminal 196 and the motor M.

The switch 200 is biased by a spring 201 to a normally open position; but it may be closed when a follower 203 is actuated by the cam surface 62 (see FIGS. 2 and 8). Referring to FIG. 2 the detent 205 of the cam surface 62 is synchronized with the other actuating cam surface to stop the drive motor M when the indexing head is returned to the start position, the upper guide member is lowered to apply the axial retaining force, the ejector finger is in retracted position, and the retainer finger is in retaining position. The coil 185A of the solenoid 185 may be connected directly across the terminals of the motor M, and one terminal of the motor M may be connected directly to normally open contact 208 of the switch 13 which is a momentary contact position.

Briefly, when the switch 13 is in the momentary contact position, the motor M and the solenoid 185 are energized for so long as the switch is held in that position.

When the function switch 13 is in the full cycle position shown in FIG. 11, nothing happens until the foot pedal is depressed, thereby closing switch 197. This will energize the coil of relay R which then closes contacts R1 to energize the motor M. The motor, in turn, rotates the cam 62 to close the switch 200 until a complete cycle of operation is completed. Thereafter, the switch 200 will open, thereby de-energizing the coil of relay R, and the contacts R1 will open to de-energize the motor M.

Persons skilled in the art will appreciate from the above detailed description, which incorporated the function of the structure disclosed as it was disclosed, how the present system operates. Having thus disclosed a preferred embodiment, persons skilled the art will be able to modify certain of the structure which has been disclosed and to substitute equivalent elements for those described while continuing to practice the principle of the invention; and it is, therefore, intended that all such modifications and substitutions be covered as they are embraced within the spirit and scope of the appended claims.

The embodiments of the invention in which an exclusive property or privilege is claimed are defined as follows:

1. Apparatus for assisting a person in winding a wire about a body having a central opening and an axis passing through said opening, comprising: a support adapted to receive said body in supporting relation and defining a slot communicating with the axis of said body when said body is placed on said support; releasable clamping means including a member adapted to engage said body and cooperate with said support to selectively apply an axial retaining force on said body; gripper means for selectively applying a lateral gripping force on said body and mounted for rotation about said axis between a start position and an indexed position; draw means for engaging said wire beneath said body and drawing the same through said opening and in wrapping engagement with said body; indexing drive means for moving said gripper means between said start and indexed position; and actuator means for releasing said clamping means from exerting said axial force on said body and for actuating said gripper means to apply said lateral gripping force on said body as said drive means moves said gripper means toward said indexed position, and for actuating said clamping means and releasing said gripper means as said drive means moves said gripper means toward said start position.

2. The apparatus of claim 1 wherein said member of said releasable clamping means comprises an upper guide member having a converging guide surface and defining a lower slot leading to the axis of said body when said body rests on said support.

3. The apparatus of claim 2 wherein said body is a toroid and said opening is circular, said guide surface being generally funnel-shaped, the axis of said toroid extending generally vertically when said toroid is received on said support, said upper guide member and said support defining elongated slots in vertical alignment communicating with the axis of said opening to facilitate the formation of a loop about said toroid.

4. The apparatus of claim 3 further comprising guide support means for supporting said guide member for vertically reciprocating motion; means for biasing said guide support means downwardly such that said guide member engages said body in clamping relation; and wherein said actuator means selectively raises said guide support means when said indexing drive means moves said gripper means from said start position of said indexed position.

5. The apparatus of claim 4 further comprising second bias means; means for mounting said second bias means to resist vertical displacement of said guide support means after said guide support means has traveled a first vertical distance, said guide support means thereafter acting against said second bias means and said first bias means.

6. The apparatus of claim 5 wherein said guide support means includes a vertically oriented shaft mounted for vertical reciprocation, a pin having an axis parallel to said shaft; receptacle means for receiving said pin over a limited vertical displacement of said shaft and guide support means to resist rotation of said shaft; and a bearing surface extending laterally of said receptacle means, whereby said guide support means may be lifted a first distance against the action of the first bias means and thereafter lifted against the action of said first and second bias means to displace said pin from said receptacle means, and said guide support means may be rotated about the axis of said shaft with said pin resting on said bearing surface to move said guide member away from the winding station.

7. The apparatus of claim 6 wherein said draw means includes at least one roller rotatably mounted on a shaft, and further comprising crank means urged by said second bias means for holding said roller in operative position with said wire; and connector means for connecting said shaft of said guide support means to said crank means to move said roller out of engagement with said wire when said support means is raised beyond said first vertical distance.

8. The apparatus of claim 1 wherein said gripper means comprises first and second jaws, each having a surface conforming to the outer shape of said body; an indexing head driven by said indexing drive means; resilient means for supporting said jaws on said indexing head while permitting said body to move slightly in an axial direction when said clamping means applies said axial retaining force on said body; and means for selectively opening said jaws as said indexing drive means returns said indexing head from said indexed position to said start position.

9. The apparatus of claim 8 wherein said body is a toroid and said opening is circular, and wherein said resilient means carrying said jaws comprises first and second flat spring arms, and wherein said indexing head comprises a base connected to said indexing drive means; first and second crank members carrying said first and second arms respectively and mounted to said base of said indexing head for rotation about axes parallel to the axis of said opening; a cradle pivotally mounted to said base means for motion between a first position in which said cradle urges said crank members to close said jaws, and a second position in which said cradle urges said crank members to open said jaws; cradle spring means for urging said cradle to said first position; and jaw opening drive means for urging said cradle to said second position against the force of said cradle spring means and in synchronism with the returning of said indexing head from said indexed position to said start position.

10. The apparatus of claim 9 wherein said cradle defines a vertical surface uniformly curved about the axis of said opening, and wherein said jaw opening drive means includes a roller adapted to engage said curved surface for moving said cradle from said first position to said second position, whereby said cradle may be actuated to said second position uniformly for all positions of said indexing head.

11. The apparatus of claim 10 further comprising manual means for moving said roller to engage said curved surface to actuate said cradle manually in any position of said indexing head.

12. The apparatus of claim 8 further comprising adjustable stop means for limiting the motion of the said indexing drive means in the indexed position to define the angular rotation of said body between loops of said wire.

13. The apparatus of claim 1 further comprising a motor for driving said indexing drive means; cycle drive means for defining a full cycle of operation for forming a loop of wire about said body and including cycle actuator means operating in spatial relationship with said indexing drive means and said first actuator means for de-energizing said motor when said indexing drive means has moved said gripper means to said start position and said first actuator means has actuated both said clamping means and said gripping means to engage said body.

14. The apparatus of claim 1 wherein said draw means comprises a driven roller and an idler roller having their surfaces in frictional engagement in an operating position and defining a nip beneath said support member for said body to engage a wire extending therethrough and drawing the same through said opening of said body.

15. The apparatus of claim 14 wherein said actuator means further includes means for separating said rollers when said indexing means has placed said gripper means in the indexed position to facilitate removal of said wire from said nip.

16. The apparatus of claim 14 further comprising retainer finger means extending across the nip of said draw rollers and normally located between the operator and the wire; ejector finger means extending across the nip of said rollers and normally located on the side of said wire opposite said retainer finger means; and ejector drive means for moving said retainer finger means to the side when said indexing drive means rotates said body, and for moving said ejector finger means parallel to said nip to engage said wire and displace it from said draw rollers outwardly toward said operator when said retainer finger means is moved to the side.

17. The apparatus of claim 16 further comprising means synchronized with said indexing drive means for moving said idler roller to the side when said indexing means rotates said body and prior to the actuation of said ejector drive means.

* * * * *